US007520120B2

(12) United States Patent
Saito et al.

(10) Patent No.: US 7,520,120 B2
(45) Date of Patent: Apr. 21, 2009

(54) APPARATUS FOR MANUFACTURING TAPED INSULATED CONDUCTOR AND METHOD OF CONTROLLING TAPE WINDING TENSION

(75) Inventors: Hisao Saito, Ibaraki (JP); Mitsuo Nanjo, Ibaraki (JP)

(73) Assignees: Hirakawa Hewtech Corporation, Tokyo (JP); Advantest Corporation, Tokyo (JP)

( * ) Notice: Subject to any disclaimer, the term of this patent is extended or adjusted under 35 U.S.C. 154(b) by 2 days.

(21) Appl. No.: 11/795,429

(22) PCT Filed: Jan. 17, 2006

(86) PCT No.: PCT/JP2006/300555

§ 371 (c)(1),
(2), (4) Date: Jul. 17, 2007

(87) PCT Pub. No.: WO2006/075762

PCT Pub. Date: Jul. 20, 2006

(65) Prior Publication Data

US 2008/0083209 A1 Apr. 10, 2008

(30) Foreign Application Priority Data

Jan. 17, 2005 (JP) ..... 2005-009638

(51) Int. Cl.
*D02G 3/38* (2006.01)

(52) U.S. Cl. ..... 57/10; 57/13; 57/17; 57/18

(58) Field of Classification Search ..... 57/3, 57/10, 13, 17, 18
See application file for complete search history.

(56) References Cited

U.S. PATENT DOCUMENTS 4,709,542 A * 12/1987 Krafft ..... 57/16
5,517,812 A * 5/1996 Simmons ..... 57/18
5,727,373 A * 3/1998 Appleford et al. ..... 57/1 UN
6,869,493 B2 * 3/2005 Tsai ..... 156/148

FOREIGN PATENT DOCUMENTS

JP 42-13560 8/1967

(Continued)

OTHER PUBLICATIONS

Patent Abstracts of Japan Publication No. 2003-187659, published Jul. 4, 2003.
Patent Abstracts of Japan Publication No. 10-291739, published Nov. 4, 1998.
Patent Abstracts of Japan Publication No. 06-124614, published May 6, 1994.
Patent Abstracts of Japan Publication N. 2005-038665, published Feb. 10, 2005.

*Primary Examiner*—Shaun R Hurley
(74) *Attorney, Agent, or Firm*—Scully, Scott, Murphy & Presser, P.C.

(57) ABSTRACT

An apparatus for manufacturing a taped insulated conductor and a method of controlling a tape winding tension. The apparatus comprises a wire material feeder feeding a wire material, a tape winder winding a tape body on the wire material fed from the wire material feeder, and a receiving device receiving the wire material on which the tape body is wound by the tape winder. A rotating shaft torque is controlled to a prescribed torque by rotatingly driving a tape pad fixing part by a torque gradually decreasing control without relying on the number of the windings of the tape body. Thus, the delivery tension of the tape body can be set to a specified prescribed value.

6 Claims, 7 Drawing Sheets

FOREIGN PATENT DOCUMENTS

| | | |
|---|---|---|
| JP | 51-17620 | 6/1976 |
| JP | 51-18991 | 6/1976 |
| JP | 2000-289939 | 10/2000 |
| JP | 2001-297633 | 10/2001 |
| JP | 2005-009638 | 1/2005 |
| WO | 2005/008689 | 1/2005 |

* cited by examiner

APPARATUS FOR MANUFACTURING TAPED INSULATED CONDUCTOR AND METHOD OF CONTROLLING TAPE WINDING TENSION

FIELD OF THE INVENTION

The present invention relates to an apparatus for manufacturing a taped insulated conductor and a method of controlling a tape winding tension, and more particularly to an apparatus for manufacturing a taped insulated conductor which forms an insulator on an outer periphery of a conductor by winding a very thin porous tape body around the outer periphery of the conductor, and a method of controlling a tape winding tension with which a winding work is stabilized by making a tape tension constant when a very thin porous tape is wound around an outer periphery of a conductor.

DESCRIPTION OF THE RELATED ART

A demand for high-speed promotion for a transmission speed, and an improvement in a transmission precision in information communication apparatuses, and semiconductor element testing/inspecting instruments or the like applied to the information communication apparatuses has increased with the progress of a recent advanced information-oriented society. For this reason, the high-speed promotion for the transmission speed and the improvement in the transmission precision has been demanded even for a coaxial cable and a coaxial code which have been applied to these apparatuses and instruments.

Here, the typical electrical characteristics required for the coaxial cable are described as follows.

Propagation transmission speed ($Td$)=$\sqrt{\in}/0.3$ (nS/m), relative transmission speed ($V$)=$100/\sqrt{\in}$ (%), characteristic impedance ($Z_0$)=$60/\sqrt{\in} \times LnD/d$ (Ω), and electrostatic capacity ($C$)=$55.63\in/LnD/d$ (pF/m)

where $\in$ is a relative permittivity of an insulator, D is an outside diameter of the insulator (an inside diameter of an external conductor), and d is an outside diameter of a conductor (an outside diameter of an internal conductor).

From the above expressions, it is possible to understand that the relative permittivity of the insulator, and the outside diameters of the internal conductor and the insulator participate in the transmission characteristics of the coaxial cable, the transmission characteristics of the coaxial cable are improved as a value of the relative permittivity is smaller, and a ratio of the outside diameter of the internal conductor to the outside diameter of the insulator, and a dispersion of the outside diameters of the internal conductor and the insulator greatly participate in the transmission characteristics of the coaxial cable.

In particular, it is possible to understand that it is ideal that with regards to the characteristic impedance and the electrostatic capacity, the relative permittivity of the insulator is small and its dispersion is less, the dispersion of the outside diameter of the internal conductor and the dispersion of the outside diameter (an inside diameter of a shielding layer) of the insulator are less, and the internal conductor and the insulator are formed in righter circular cylindrical shapes, respectively.

In the conventional coaxial cable, for the purpose of reducing the propagation delay time in the coaxial cable as much as possible, thereby increasing the transmission speed, at present, a porosity (foaming rate) of a foamed insulator applied to the coaxial cable is set as 60% or more to form many voids, thereby setting the relative permittivity ($\in$) of the insulator as 1.4 or less. As a result, the shortening of the transmission time, the reduction of an amount of attenuation of the transmission signal, and the like are realized. A porous tape body made of polytetra-fluoroethylene (PTFE) is wound as an insulator material having a porosity of 60% or more, and a relative permittivity of 1.4 or less around an outer periphery of an internal conductor, and is subjected to a firing treatment in a phase of the winding or after the winding. The porous tape body concerned is applied to the coaxial cable (refer to Japanese Patent Publication No. JP S42 (1967)-13560 B1 and Japanese Patent Publication No. S51 (1976)-18991 B1 (hereinafter referred to as "Patent literary documents 1 and 2"). Also, a polyethylene tape body made of polyethylene having an average molecular weight of five millions or more is applied as a porous tape body other than the porous tape body described above to the coaxial cable (refer to Japanese Laid Open Patent Application No. 2001-297633 A1 hereinafter referred to as "Patent literary document 3"). Each of these insulator layers is large in dispersion of the thickness and the porosity in terms of a property of the porous tape body. Thus, the improvement in such a dispersion is strongly demanded in terms of the stability of the transmission characteristics of the coaxial cable.

In particular, in the coaxial cable which includes a fine-diameter conductor having an internal conductor size of 24 or more in AWG size, and which has a characteristic impedance value of 50Ω, the dispersions of the thickness, the outside diameter, the porosity, the firing process and the like of the insulator layer become a serious hindrance when the stabilization is realized by removing the dispersion of the transmission characteristics.

In addition, the insulator layer is structured by repeatedly winding the porous tape body around the outer periphery of the internal conductor. Therefore, irregularities in the outside diameter occur in a part in which the tape body is repeatedly wound around the outer periphery of the internal conductor due to the void parts and the repeated winding, so that the dispersions of the relative permittivity and the outside diameter become very large.

In addition, the porous tape body having the very small mechanical strength is used in this insulator layer. Thus, the tension applied to the tape body must be made very small in order to prevent the extension and tearing of the tape body itself from occurring in the phase of the winding, and to prevent the extension and snapping of the internal conductor having a very fine diameter from occurring due to the winding of the porous tape body. For this reason, the irregularities in the outside diameter, and the dispersion of the outside diameter further increase in the insulator after the winding work. Also, the dispersions of the relative permittivity and the outside diameter further increase because a degree of adhesion between the internal conductor and the insulator after the winding work is very weak.

Moreover, there is encountered such a serious problem that it is difficult to form the insulator in right circle cylindrical shape as well as to keep the outside diameter of the insulator to a prescribed outside diameter, thereby removing the dispersion of the insulator outside diameter.

Although the various problems to be solved when the insulator of the coaxial cable is constructed by applying the porous tape body to the coaxial cable have been enumerated so far, an apparatus for manufacturing a taped insulated conductor which can stably wind a thin tape around an outer periphery of a wire material such as a very fine wire at a high speed while a fluctuation in a tension is suppressed is disclosed as a conventional example of an apparatus for manufacturing a taped insulated conductor which winds a thin tape around an outer periphery of an internal conductor, thereby constructing an insulator (refer to Japanese laid Open Patent Application No. H06 (1994)-124614 A1 hereinafter referred to as "Patent literary document 4").

Concretely describing now the invention disclosed in Patent literary document 4 with reference to FIG. 7, the apparatus for manufacturing a taped insulated conductor includes: a reel shaft 51 which includes a through hole 52 for passing therethrough a wire material 521 from a lower side to an upper side with the shaft 51 as a center, and air blowing-out holes 53, each constituting an air bearing, which are provided in an outer periphery of a shaft part 51*a*, and a flange surface for supporting a tape reel guard from a lower side, respectively, and which is rotatably and vertically installed; an inverted funnel-like flyer 510 which is rotatably and coaxially provided in an upper part of the reel shaft; a tape cover 517 which is stuck to an outer surface of the flyer 510; a tape winding-up guide 518 and a tape pressure 519 which are provided in an upper part of the flyer 510 and which are rotated together with the flyer 510; and motors 57 and 513 which rotates individually the reel shaft 51 and the flyer 510; in which after a tape 532 delivered from a tape reel 531 mounted to the real shaft 51 is passed through a guide 516 provided in an outer periphery edge of a lower part of the flyer 510, the tape 532 is made to travel under the tape cover 517 and is guided around the wire material 521 via the tape winding-up guide 518 and the tape pressure 519, air blowing out through the air blowing-out holes makes the tape reel float and bears the tape reel so as to have a prescribed rotating resistance, the flyer 510 is rotated at a constant speed while the wire material is passed at a prescribed speed in this state, and the reel shaft is rotated at a speed corresponding to a reel winding diameter, thereby winding the tape around the outer periphery of the wire material.

According to the apparatus for manufacturing a taped insulated conductor, it is described that the apparatus for manufacturing a taped insulated conductor has such an advantage that the tape body is hardly influenced by a centrifugal force or a wind, and since even when the tape body is wound at the constant speed, the fluctuation in the tape winding tension is suppressed and the fluctuation width of the tape winding tension is further reduced in the winding part by an automatic fine adjustment operation generated between the tape reel made to float by the air and the reel shaft, even for the very thin tape which is easy to tear, a proper tension is held, and the winding operation can be performed at a high speed under a stable state, and also the tape winding pitch and the tape winding state are fixed.

Japanese Laid Open Patent Application No. 2000-289939 hereinafter referred to as "Patent literary document 5" discloses a tape delivery tension adjustment apparatus in which a tape delivery tension is controlled in accordance with data obtained by previously measuring a correlation among a taping head rotating speed, an operating state signal, and a braking force, which results in that the adjustment for the tape delivery tension is automatically performed.

However, the conventional apparatus for manufacturing a taped insulated conductor involves the following problems. (1) Since the tape reel is floated by the air and is rotated with the rotation of the reel shaft, thereby feeding the tape, the tension for the tape feed is easy to change depending on the magnitude of the number of windings of the tape body wound around the tape reel. (2) Since the tape winding tension changes due to an unbalance in the number of rotations between the motors 57 and 513, and the number of windings of the tape body changes accordingly, the winding shape is hardly to be fixed. (3) Since the tape length from the tape feed part to the tape pressure 519 is long and thus the tape tension in the tape feed part does not agree with that in the tape winding part, the tape is easy to tear due to a wind pressure in the phase of the winding of the tape body. (4) The winding tension of the tape occurs from contact with the guide hole 516, the tape cover 517, and the tape winding-up guide 518, and thus is easy to change due to a relative large contact area and the number of rotations of the flyer 510. (5) Since from the problems (1) and (2), the tape winding tension provided by the tape feed and the tape winding is not stabilized, and thus the tape winding becomes unstable, the external shape of the wound tape has irregularities, and also the tearing of the tape is easy to occur. (6) Since the length of the tape which is delivered from the tape reel, from the tape reel to the tape winding part (the tape pressure 519) is long, the tape receives the wind pressure caused by the rotation of the flyer 510, and thus the tape winding tension is easy to change. (7) The tape delivering operation is controlled such that when the actual torque is larger than a specified torque, the tape body is delivered, while the actual torque is smaller than the specified torque, the braking is performed, so that the reel shaft torque becomes constant. However, since the tape delivering tension is controlled (increased or decreased) in accordance with the specified torque, a large nonuniformity occurs in the tape delivering tension when the number of windings of the tape body changes. (8) Although a receiving device for receiving the cable having the tape body wound therearound usually rotates at a set rotational frequency to receive the cable, no control is performed so that the cable receiving speed and the speed at which the tape body is wound around the cable are synchronized with each other, and thus the receiving device does not perform the receiving operation in which the winding-up pitch of the tape body is set as a specified value.

Therefore, it is an object of the present invention to provide an apparatus for manufacturing a taped insulated conductor, and a method of controlling a tape winding tension each of which is capable of solving any of the above-mentioned problems, and thus winding a tape body without occurrence of extension and tearing of the tape body, and maintaining an outside diameter of an insulator in a prescribed outside diameter, thereby fixing a winding shape when an insulator layer made of a porous tape body is formed.

SUMMARY OF THE INVENTION

In order to attain the above-mentioned object, the first invention provides an apparatus for manufacturing a taped insulated conductor including a wire material feeder for feeding a wire material, a tape winder for winding a tape body around the wire material fed from the wire material feeder, and a receiving device for receiving the wire material around which the tape body is wound by the tape winder, the tape winder including: a tape pad fixing part for fixing a tape pad around which the tape body is wound; a tape feed part having a first drive source including a servo motor for rotatingly driving the tape pad fixing part, so that a rotating shaft torque is controlled to a prescribed torque, thereby setting a delivery tension of the tape body to a prescribed value; a tape winding flyer rotatably mounted to an outside of the tape feed part; and a tape winding part having a second drive source including a servo motor for controlling a rotation of the tape winding flyer to the prescribed number of rotations; in which the tape body is fed from the tape pad to the tape winding flyer without a tension with the rotation having the rotating shaft torque controlled by the first drive source; the tape body fed to the tape winding flyer is wound around the wire material in a state in which a tension of the wire material is set to a specified value by the rotation made by the second drive source.

In the first invention described above, a drive source for the receiving device may be a servo motor for controlling the number of rotations to the prescribed number of rotations in order to set a receiving speed at which the wire material is received to a prescribed speed. In addition, the tape winding flyer may have a plurality of tension control rolls for controlling a tension of the tape. Also, the second drive source may rotatingly drive the tape winding flyer synchronously with the prescribed number of rotations used to make the receiving speed for the wire material constant by the drive source for the receiving device.

In order to attain the above-mentioned object, the second invention provides a tape winding tension controlling method of controlling a tension applied to a tape body for use in an apparatus for manufacturing a taped insulated conductor including a wire material feeder for feeding a wire material, a tape winder for winding the tape body around the wire material fed from the wire material feeder, and a receiving device for receiving the wire material around which the tape body is wound by the tape winder, in which when a tension of the tape body in the tape winder is controlled, a delivery tension of the tape body is set to a prescribed value by controlling a rotating shaft torque to a prescribed value by a first drive source having a servo motor for rotatingly driving a tape pad fixing part for fixing a tape pad around which the tape body is wound; and next, for the tape body fed to a tape winding flyer mounted to an outside of the tape pad fixing part, a tension applied to the tape body to be wound around the wire material is usually set to a specified tension without relying on the number of windings of the tape body by controlling the number of rotations to the prescribed number of rotations by a second drive source having a servo motor for rotatingly the tape winding flyer.

In the second invention described above, a receiving speed at which the wire material is received may be controlled to a prescribed speed by controlling the number of rotations to the prescribed number of rotations by a servo motor as a drive source for the receiving device. In addition, the tension of the tape body right before the tape body is fed to the tape winding flyer and is wound around the wire material may be set to a prescribed tension obtained by twining the tape body around each of a plurality of tension control rolls provided in the tape winding flyer. Also, the second drive source may rotatingly drive the tape winding flyer synchronously with the prescribed number of rotations used to make the receiving speed for the wire material constant by a drive source for the receiving device, so that a winding pitch of the tape body wound around the wire material is controlled to a constant value.

According to the present invention, the irregularities in the insulator outside diameter, and the dispersion of the outside diameter which are caused by the dispersion or the like of the winding tension can be reduced by fixing the tension and the winding angle of the porous tape body (especially having a porosity rate of 60% or more) to be wound around the wire material. In addition, the influence of the wind force due to the rotation is reduced in addition to the fixing of the winding tension of the porous tape body, which results in that the porous tape body can be prevented from being torn due to the winding and can be uniformly wound, and also the fluctuation, the undulation or the like of the insulator outside diameter can be prevented from occurring. The present application is based on Japanese patent application No. 2005-009638, the entire contents of which are incorporated herein by reference.

The present invention is constituted in the manner as described above, and thus offers the effects as will be described below. That is to say, according to the present invention, the tape body can be delivered from the tape pad while the tape delivering tension is held constant without relying on the number of windings of the tape body in accordance with the torque gradually decreasing control. Moreover, since the tension with which the tape body is wound around the wire material (conductor) is held constant in accordance with the control made by the tension control rolls provided in the tape winding flyer, it is easy to wind the tape body around the wire material, and thus the degree of adhesion of the tape body to the wire material in the winding is fixed. Consequently, it is possible to provide the apparatus for manufacturing a taped insulated conductor which is capable of manufacturing an electric wire through the stable tape winding.

In addition, each of the tape body delivery tension and the winding tension can be usually fixed without relying on the number of windings of the tape body in accordance with the torque gradually decreasing control, and can be made a minimum tension. Moreover, the influence of the wind pressure due to the winding can be reduced by making the tape body contact the tension control rolls and the tape guide rolls at intervals of a short period of time. Therefore, even the tape body having a small tension applied thereto can be wound around the wire material.

Furthermore, the tape winding flyer is driven synchronously with the drive motor of the receiving device in accordance with proportional control made by the tape winding flyer and the drive motor of the receiving device, which results in that the manufacturing speed and the product pitch can be made constant irrespective of an acceleration and a deceleration.

DETAILED DESCRIPTION OF THE INVENTION

Figure 1:
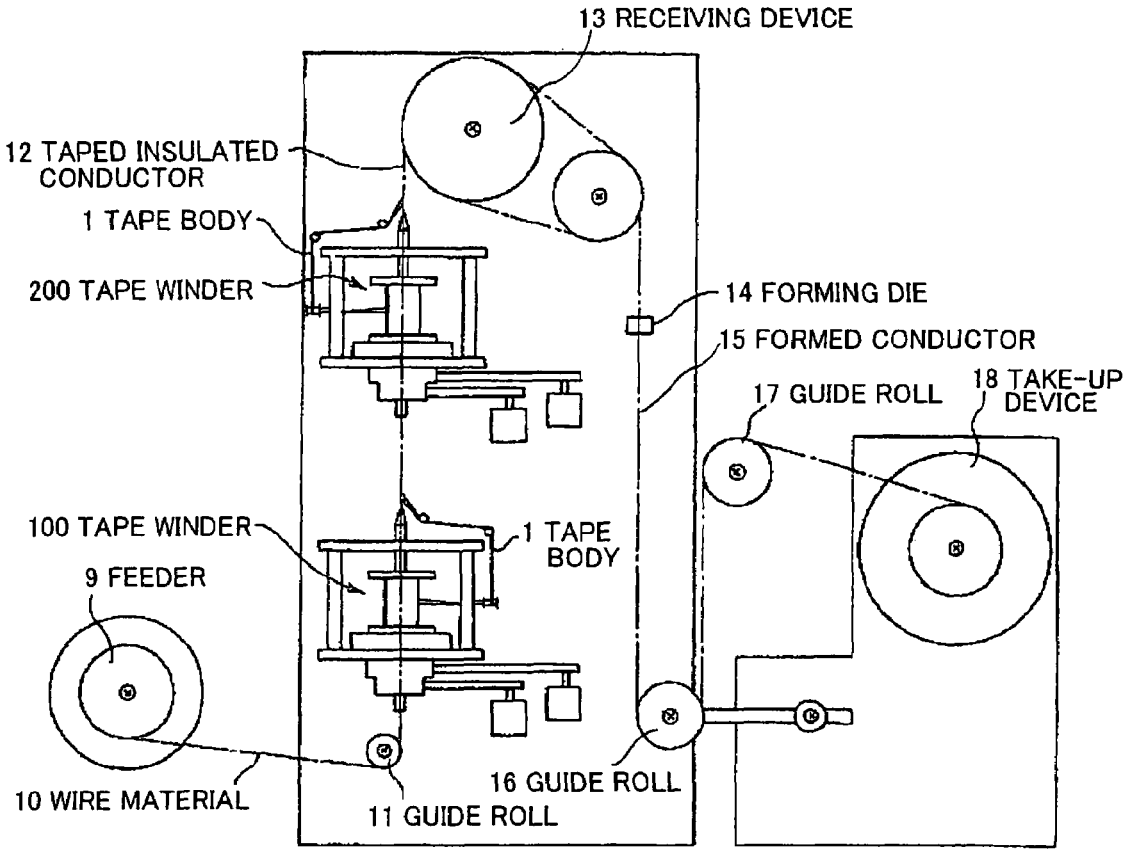
FIG. 1 is a schematic side elevational view showing an apparatus for manufacturing a taped insulated conductor of the present invention.
Figure 2:
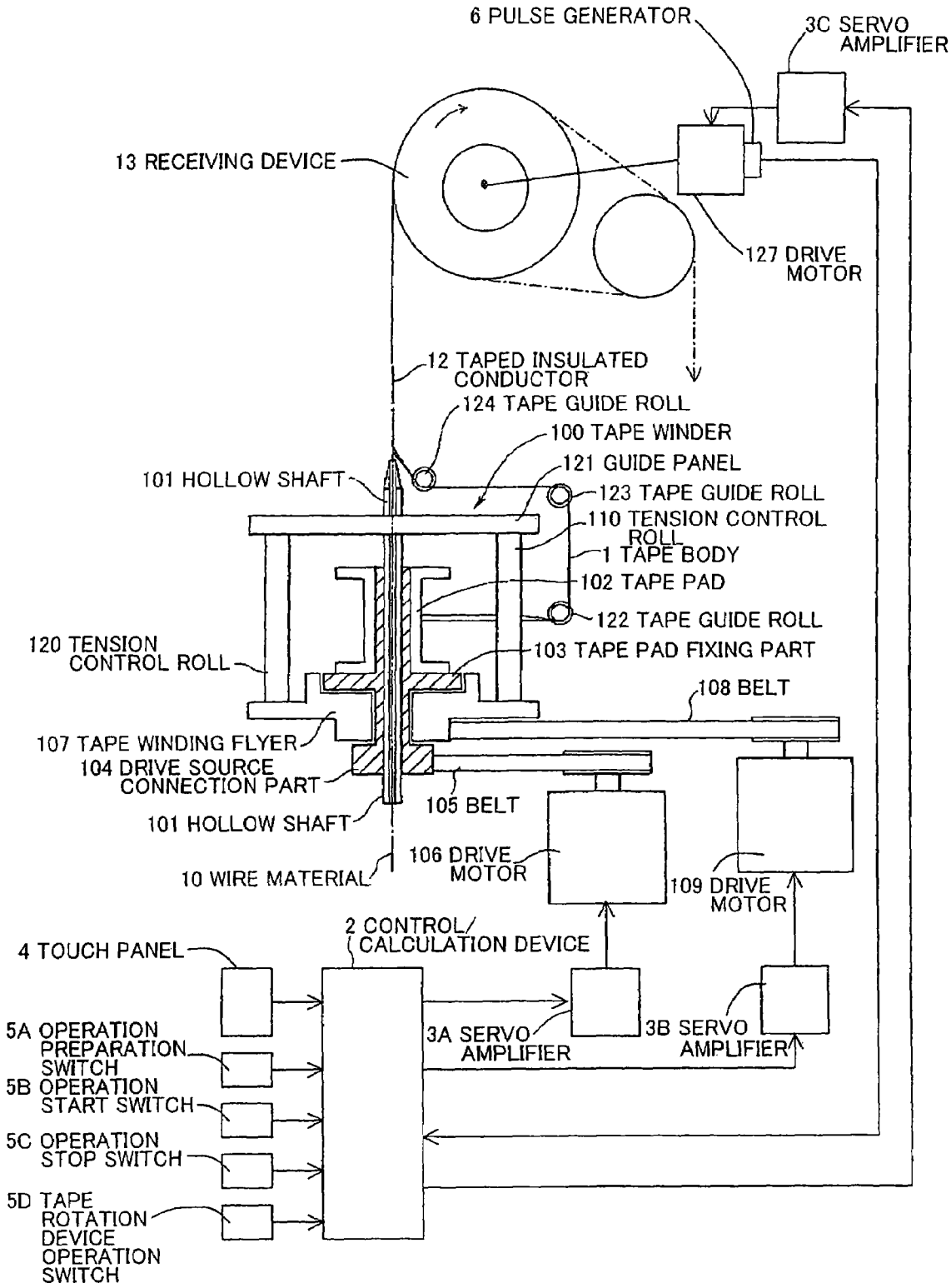
FIG. 2 is a cross sectional view showing details of a tape winder shown in FIG. 1.
Figure 3:
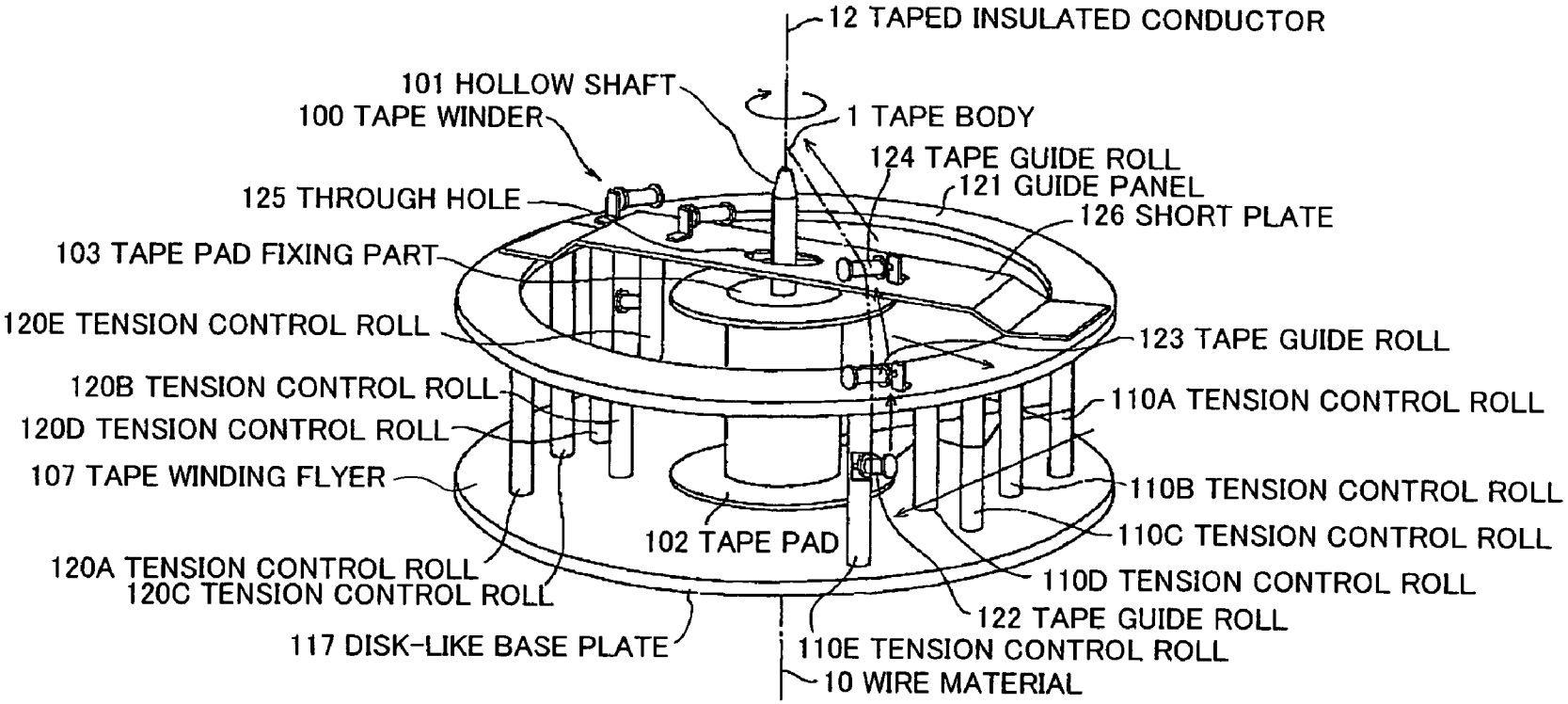
FIG. 3 is a perspective view showing a main part of the tape winder.
Figure 4A:
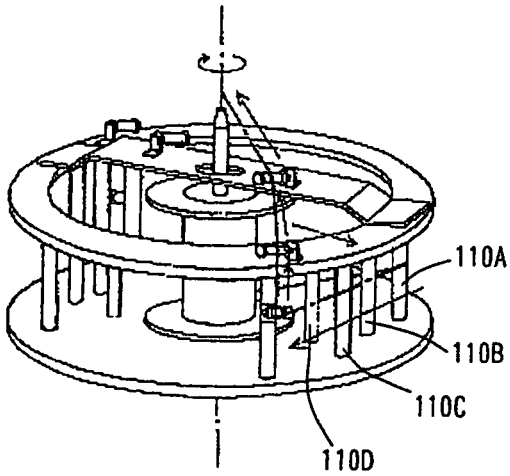
FIGS. 4(*a*) to 4(*d*) are respectively perspective views each showing a main part of the tape winder for setting a tape tension to a prescribed value.
Figure 4B:
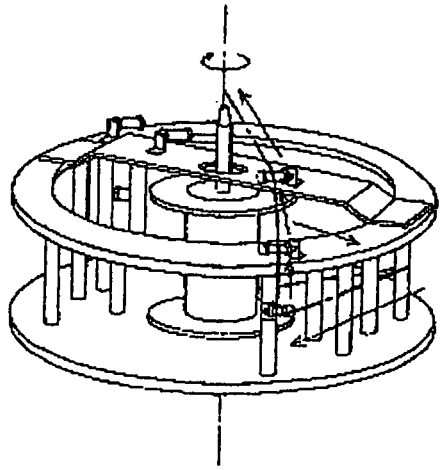
Figure 4C:
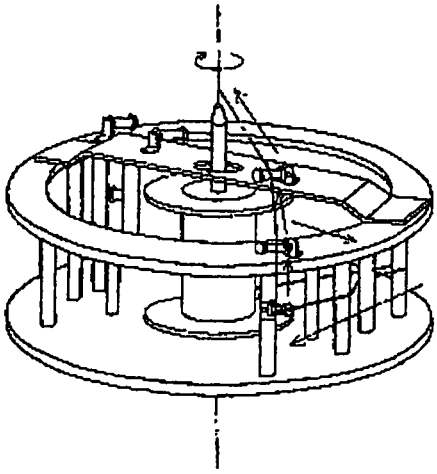
Figure 4D:
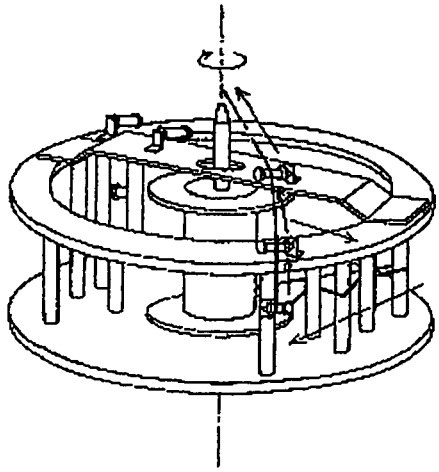

An embodiment of the present invention will be described hereinafter with reference to FIGS. 1 to 5. FIG. 1 is a schematic side elevated view showing an apparatus for manufacturing a taped insulated conductor of the present invention. FIG. 2 is a cross sectional view showing details of a tape winder shown in FIG. 1. FIG. 3 is a perspective view showing a main part of the tape winder, and FIGS. 4(*a*) to 4(*d*) are respectively perspective views each showing a main part of the tape winder for setting a tape tension to a prescribed value.

The apparatus for manufacturing a taped insulated conductor shown in FIG. 1 includes a feeder 9 for feeding a wire material 10, a guide roll 11 for guiding the wire material 10 thus fed, tape winders 100 and 200, a receiving device 13 for receiving a taped insulated conductor 12 around which a tape body 1 is wound by the tape winders 100 and 200, a forming die 14 for forming the taped insulated conductor 12 in right circular shape having a prescribed outside diameter, guide rolls 16 and 17 for guiding a formed conductor 15 thus formed, and a take-up device 18.

That is to say, the wire material 10 fed from the feeder 9 is firstly guided in the guide roll 11 in order to pass the wire material 10 through the tape winder 100. After the tape body 1 is wound around the wire material 10 thus guided in the tape winder 100, subsequently, a tape is wound around the wire material 10 in the tape winder 200, and the taped insulated conductor 12 obtained through the tape winding is guided to the forming die 14 via the receiving device 13. The taped insulated conductor 12 is formed in right circular shape having a prescribed outside diameter in the forming die 14, and the formed conductor 15 thus formed is guided to the take-up device 18 through the guide rolls 16 and 17, and is taken up by the take-up device 18.

The wire material 10 is principally an internal conductor as a core material of an electric wire or the like, especially, a foamed coaxial cable in the present invention, particularly, a high-precision foamed coaxial cable having a characteristic impedance value of ±1 Ω. In addition, the present invention is especially suitable for an internal conductor having a fine diameter, for example, an internal conductor having a size of 24 to 30 in AWG size.

A porous tape body, especially, a porous tape body which has a porosity of 60% or more and a relative permittivity (∈) of 1.4 or less, for example, PTFE or polyethylene having an average molecular weight of five millions or more is used as the tape body 1. Here, the tape body which is subjected to the firing treatment may be wound, or the firing treatment may be performed for the tape body in the phase of the winding or after the winding.

The guide rolls are not necessarily specially provided and also the present invention not limited to the guide rolls as long as the wire material 10 is suitably guided to the tape winders 100 and 200, the receiving device 13, the forming die 14, and the take-up device 18. The number of guide rolls, the shape and the like thereof are not especially limited.

The receiving device 13 has a function as well of guiding the taped insulated conductor 12 to the forming die 14, and may be a simple guide roll. A construction may be adopted such that guide rolls are provided separately from the receiving device 13.

The forming die 14 is provided between the receiving device 13 and the take-up device 18, and has a prescribed inside diameter and a prescribed inside diameter length, for example, has an inside diameter of 1.12 mm, and an inside diameter length of 3.00 mm. The taped insulated conductor 12 is passed through such a forming die 14 to be formed in right circular shape having an outside diameter of 1.12±0.02 mm. The taped insulated conductor 12 may be gradually formed by using a plurality of forming dies, for example, two forming dies.

In addition, although FIG. 1 shows the apparatus for manufacturing a coaxial cable which has the two tape winders (100, 200) provided in lower and upper sides, respectively, as one for manufacturing the coaxial cable, only one tape winder may be provided for any of other applications.

Next, the tape winder 100 shown in FIG. 1 will be described in detail with reference to FIGS. 2 and 3. The tape winder 100 has a tape body feed part including a hollow shaft 101 for pressingly passing therethrough the wire material 10 at its center to guide it, a tape pad 102 around which the tape body 1 is wound, a tape pad fixing part 103 to which the tape pad 102 is fixedly mounted, a drive source connection part 104 provided in an end part of the tape pad fixing part 103, and a drive motor 106 connected to the drive source connection part 104 by a belt 105 or the like. The tape pad 102 may be fixed to the hollow shaft 101 through the tape pad fixing part 103, or may be directly fixedly fastened to the hollow shaft 101. The tape pad fixing part 103 is fixedly mounted to an outer periphery of the hollow shaft 101.

A tape winding flyer 107 is mounted to the outside of the tape pad fixing part 103 so that it can make a rotation different from that of the tape pad fixing part 103. A drive motor 109 is connected to one end of the tape winding flyer 107 through a belt 108.

The tape winding flyer 107 has a plurality of tension control rolls 110 (110A to 110E) and 120 (120A to 120E) which are vertically mounted to a disc-like base plate 117, and has a ring-like guide panel 121 in the other end thereof. Preferably, three to seven tension control rolls are provided across the hollow shaft 101 from three to seven tension control rolls on the disc-like base plate 117. More preferably, five tension control rolls are provided across the hollow shaft 101 from five tension control rolls. A short plate 126 having a through hole 125 through which the hollow shaft 101 extends completely is mounted to the guide panel 121.

Tape guide rolls 122, 123 and 124 are mounted to the tension control roll 110E, the guide panel 121, and the short plate 126, respectively. Each of the tape guide rolls 122, 123 and 124 has not only a function of guiding the tape body 1 to a head part of the hollow shaft 101, but also a function of reducing an influence by a wind pressure which is generated with the rotation of the tape winder 100 in the phase of the tape winding and which is applied to the tape itself.

The tension control rolls 120 (120A to 120E), the tape guide roll provided on the tension control roll 120E, the tape guide roll provided on the guide panel 121 on an opposite side, and the tape guide roll provided on the short plate 126 on an opposite side are illustrated in FIGS. 2 and 3. These rolls are used when the tape body is wound in an opposite direction, and also are used to fix the balance among these rolls and the rolls opposite thereto with an axis of the tape winder as a center.

The above-mentioned tension control rolls adjust the tension of the tape body to be wound. With respect to the disposition thereof, the tension control rolls 110A, 110C, 110E, and 120A, 120C, 120E are vertically mounted to the disc-like base plate 117 in positions each being located at a distance of about 200 mm from a center of the wire material 10 passing through the hollow shaft 101, and the tension control rolls 110B, 110D and 120B, 120D are vertically mounted to the disc-like base plate 117 in positions each being located at a distance of about 150 mm from the center of the wire material 10. These tension control rolls are disposed in a staggered arrangement with a deviation of about 45 degrees (45 degrees to a central side or outside with respect to a straight line linking the nearest two tension control rolls (for example, 110A and 110C, or 110B and 110D) which are at the same distance from the center of the wire material 10) (for example, an angle BAC is 45 degrees)). Thus, these tension control rolls are constructed so that the tape body is guided to the tape guide rolls 122, 123 and 124. Moreover, these tension control rolls 110A to 110E, and 120A to 120E are fixed and integrated with one another between the tape wiring flyer 107 and the guide panel 121.

FIGS. 4(*a*) to 4(*d*) show a main part of the tape winder for setting the tape tension to a prescribed value. Here, the tension of the tape body itself relating to the tape winding depends on a contact area with which the tape body is twined around each of the tension control rolls, and thus depends on a thickness of each of the tension control rolls, and a size of contact of the tape body abutting against each of the tension control rolls. For example, a thickness of the tension control roll 110A is set in the range of about 20 to about 40 mm, and is preferably set to about 30 mm, so that a contact angle of about 180 degrees is obtained. Thus, the tension depends on the contact angle, and an area about a width of the tape body to be wound. In this embodiment, the tension control roll 110A is constructed so that the tape tension of about 0.2 N is obtained. When the tension of the tape body may be about 0.2 N (FIG. 4(*a*)), after being turned in the tension control roll 110A, the tape body is guided to the winding part via the tape guide rolls 122, 123 and 124. When the tension of the tape body is set to a larger value, the tape body is successively twined around the tension control rolls 110B (2 turns: 0.4 N), 110C (3 turns: 0.6 N), and 110D (4 turns: 0.8 N) each of which is deviated from the tension control roll 110A by about 45 degrees (FIGS. 4(*b*) to 4(*d*)) (so that each of an angle ABC and an angle BCD becomes about 45 degrees). The tape body has the contact angle of about 90 degrees through the twining process, and thus the tension of the tape body depends on that contact angle, and the area about the width of the tape body wound. In this embodiment, the setting is made so that the tension of about 0.2 N per one roll is generated by twining the tape body around each of the tension control rolls 110B, 110C and 110D.

Next, a concrete method of actually winding the tape body by using the apparatus for manufacturing a taped insulated conductor will be described hereinafter. Firstly, the wire material of AWG#26 is made to travel at a speed of 10 m/min between the feeder 9 and the take-up device 18. The fired PTFE tape body 1 which has the porosity of 60% or more and which is 4.6 mm in tape width and 0.09 mm in thickness is wound in a half-lap basis around the outer periphery of the traveling wire material 10 by the tape winder 100. The tape body to be wound is drawn out from the tape pad 102, is twined around the tension control roll 110A on the tape winding flyer 107 to adjust the tension, and is fed to the head part of the hollow shaft 101 through the tape guide rolls 122, 123 and 124. The tape pad fixing part 103 and the tape winding flyer 107 are rotated at 100 rpm and at 1500 rpm by driving the drive motors 106 and 109, respectively, and the tape body 1 is wound around the outer periphery of the wire material 10 which is guided along the hollow of the hollow shaft 101. Here, a difference in number of rotations between the tape pad fixing part 103 and the tape winding flyer 107 results from a difference in an outer periphery diameter between the tape pad 102 and the tape wiring flyer 107.

(Basic Matters of Torque Control) Next, a description will now be given with respect to the basic matters such as a relationship between the output torque and the tension becoming the basis of the gradually decreasing control for the output torque which will be described later. In a mechanism for giving driving or braking by a bobbin or pad central axis, the output torque is expressed by the following expression. Output torque (T)=tension (F)×winding radius (R) where a winding radius (R) is a vertical distance from a rotation center of the tape body 1 wound around the tape pad 102.

When the tension fixing control in the case of winding thinning (when a residual quantity of tape body decreases with the progress of the tape winding), that is, the delivery control is performed, since tension (F)=T/R is obtained from the above expression, in order to make the tension (F) constant, it is necessary to perform the control for reducing the output torque (T) by a decrease amount in the gradually decreasing winding radius (R) of the tape pad.

The description stated above is the basic idea for the tension control coping with a change in winding diameter (a change in residual quantity of tape body in the tape pad), and corresponds to a phase of a so-called "static torque" which is free from any of factors such as a mechanical loss and an operating condition. However, since the actual work form is complicated and thus the following factors are necessarily added to the above-mentioned factors, the idea of a so-called "dynamic torque" must be added thereto. (1) Severe operating conditions (an acceleration time and a deceleration time), (2) a tension range (specified tension management level), and (3) a moment of inertia (INERTIA) or GD2 which represents the difficulty of rotating an object, or the difficulty of stopping a rotating object.

The tension fixing control must be selected in correspondence to the precision of the control level obtained from the factors as described above. In general, there is performed the fixing tension control by delivery, take-up or dancer of the wire material by the motor driving. However, since an influence of an inertial force increases, and the torque fluctuation range increases as the acceleration time or the deceleration time is shorter, and the management level for the specified tension is higher. Therefore, in this case, a degree of difficulty increases in terms of the technique.

The tape pad 102 of the tape body 1 of the present invention has a light weight, is located inside the tape winding flyer 107, and is independent and stable. Thus, the tension fixing control coping with the winding thinning is adopted as the tension control. Also, the output torque is gradually decreased, that is, gradually weakened by a decrease amount in the number of windings of the tape body, thereby fixing the tape tension in the phase of delivery of the tape main body 1.

(Torque Control by Servo Motor) In FIG. 2, the tape winding head construction has a two-layer constitution including a part in which the drive motor 106 for giving the tape pad 102 the torque, the belt 105 for transmitting a power of the drive motor 106, and the tape pad fixing part 103 are integrated with one another through the drive source connection part 104, and a part including the drive motor 109 for rotating the tape winding flyer 107 for winding the tape body 1 around the wire material 10, and the belt 108 for transmitting a power of the drive motor 109. Since the delivery tape tension of the tape pad 102 changes with a change in number of windings of the tape body, the torque control is performed by the drive motor 106. That is to say, there is adopted a mechanism for calculating a necessary output torque with a pulse generated by a pulse generator 6 as a reference by a control/calculation device 2, thereby automatically and gradually decreasing the output torque which is set in the form of a voltage divided into 1000 steps and which is applied to the tape pad 102 in correspondence to a decrease amount of tape body, and thus fixing the delivery tension of the tape body 1. Note that, the tape body 1 is wound around the wire material 10 by driving the drive motor 109 so that the tape body winding pitch become constant irrespective of an acceleration and a deceleration in accordance with the proportional control established between the drive motor 127 of the receiving device 13 shown in FIG. 1 and the drive motor 109.

Figure 5:
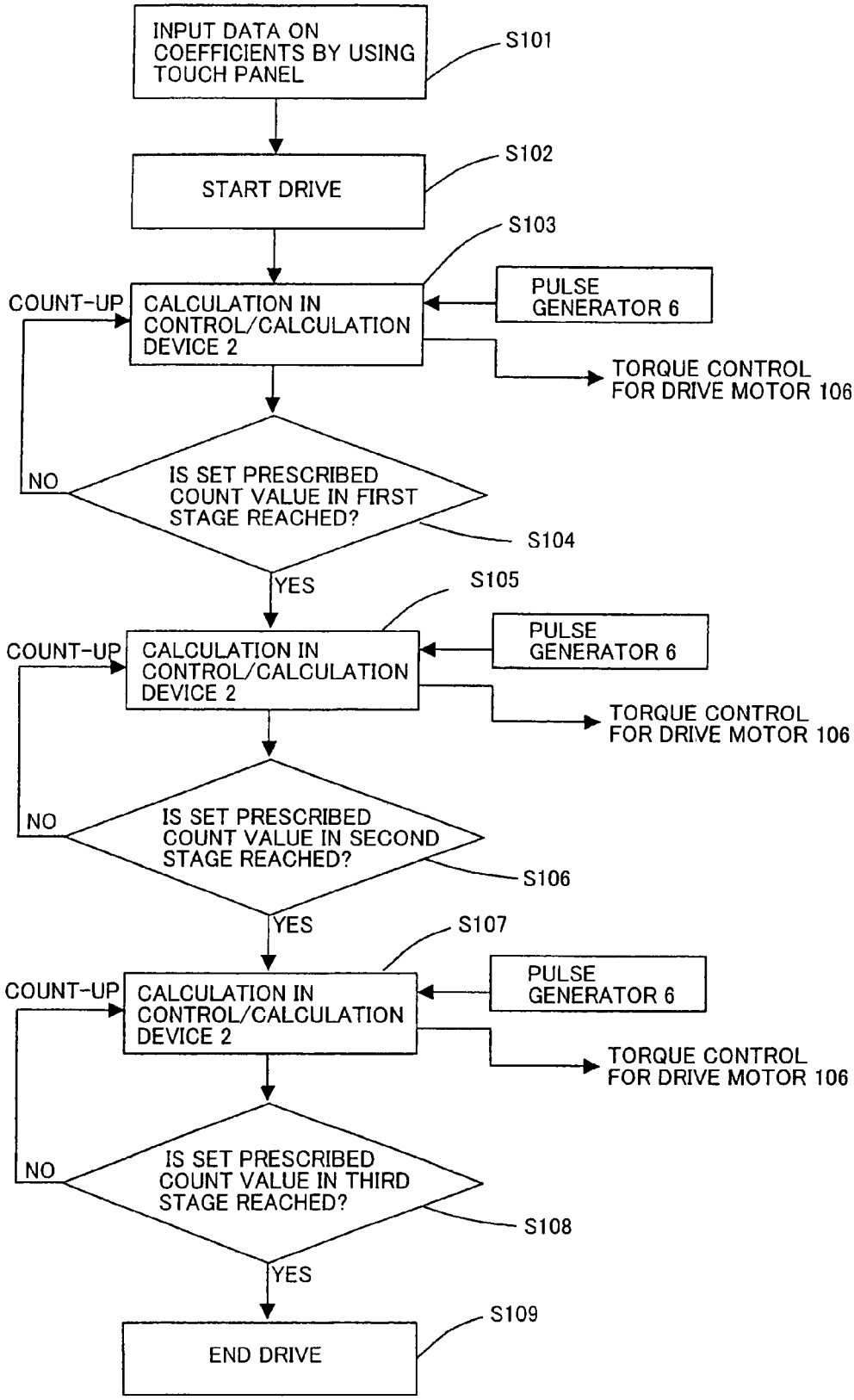
FIG. 5 is a flow chart showing a procedure of torque gradually decreasing control according to the present invention.

(Torque Gradually Decreasing Control in Phase of Delivery of Tape Body 1) FIG. 5 is a flow chart showing a procedure for the torque gradually decreasing control according to the present invention. The torque gradually decreasing control will be described hereinafter in due order with reference to FIG. 2 and the flow chart shown in FIG. 5.

Firstly, in Step S101, data on coefficients is inputted by using a touch panel 4. That is to say, there are inputted an offset value with which a zero point of the torque is shifted to a minus side in order to prevent the tape pad fixing part 103 in the phase of start of the operation from being swung by the rotating speed of the drive motor 109, and a constant of an addition torque value in the phase of deceleration.

In order to torque-control the drive motor 106, the torque gradually decreasing value given to the tape pad fixing part 103 is inputted as the torque gradually decreasing value in three stages. A total length value of the tape body 1, and an initial torque value of the drive motor 106 are set. Next, a value of a length of the tape body 1 used in a section in a first stage, and an end point torque value in the first stage of the drive motor 106 are set. Next, a value of a length of the tape body 1 used in a section in a second stage, and an end point torque value in the second stage of the drive motor 106 are set. Next, a value of a length of the tape body 1 used in a section in a third stage, and an end point torque value in the third stage of the drive motor 106 are set. Also, a value of the number of rotations of the drive motor 109, a product winding pitch set value, and a value of a length of a received tape body are inputted to the control/calculation device in order to manage these values as data by using the touch panel 4.

Next, in Step S102, the apparatus for manufacturing a taped insulated conductor starts to be driven. When an operation preparation switch 5A is turned ON, a signal representing whether or not the conditions required for the operation become complete is inputted to the control/calculation device 2, and the control/calculation device 2 performs the self-judgment about the contents of this signal. When the conditions required for the operation become complete, a blue light is turned ON in the touch panel 4. A signal representing operation preparation is inputted to the control/calculation device 2. A signal is inputted from the control/calculation device 2 to a servo amplifier 3A for the drive motor 106. As a result, initial torque data is set in the drive motor 106. A signal representing operation start is inputted to the control/calculation device 2 by manipulating an operation start switch SB. A signal is inputted from the control/calculation device 2 to a servo amplifier 3B for the drive motor 109. At the same time that the drive motor 109 starts to be driven so that the number of rotations thereof increases up to the predetermined number of rotations, an operation start signal is inputted to a servo amplifier 3C as well. Thus, the drive motor 127 starts to be driven so that a prescribed reception speed set value is reached in accordance with the proportional control with the start of the driving for the drive motor 109. When the drive motor 127 of the receiving device 13 is driven, a pulse signal is inputted from the pulse generator 6 to a high-speed counter unit provided within the control/calculation device 2. Thus, the pulse signal is inputted is the control/calculation device 2. Then, the control/calculation device 2 performs the calculation in real time with the product winding pitch set value data as a reference. Thus, the drive motor 109, and the drive motor 127 of the receiving device 13 are proportionally controlled in their rotations, that is, are driven synchronously with each other, which results in that a specified tape body winding pitch is usually formed.

In Step S103, the torque gradually decreasing control in the first stage is started. At the same time that the drive motor 127 is driven to start to rotate, the pulse signal is inputted at 0.1 m intervals from the pulse generator 6 to the high-speed counter unit provided within the control/calculation device 2. Here, the pulse generator 6 is constituted by a rotary encoder having slits so as to generate 10 pulses with one rotation of the drive motor 127, and also is constituted so as to generate 1 pulse whenever the receiving device 13 receives the taped insulated conductor 12 by 0.1 m. In a calculation part of the control/calculation device 2, a result of dividing the set data on the length of the tape body 1 used in the section in the first stage by a coefficient of 1000 is counted up synchronously with the pulse signal. In addition, a result of dividing a difference between the initial torque value set data for the drive rotor 106, and the end point value set data in the first stage for the drive motor 106 by the coefficient of 1000 in the calculation part of the control/calculation device 2 is decreasingly changed little by little from the initial torque value set data for the drive motor 106 every count-up. That is to say, the result is inputted as a digital signal to a digital-analog conversion unit provided within the control/calculation device 2, and a current is outputted as an analog signal which is changed to slightly decrease from the control/calculation device 2. Thus, a signal is inputted to the servo amplifier 3A, and a voltage which is changed to slightly decrease is outputted to the drive motor 106, which results in that the torque outputted from the drive motor 106 is changed to decrease in correspondence to the value of the length of the tape body 1 used in the section in the first stage, thereby fixing the delivery tension of the tape body 1.

Also, in Step S104, the data on the length of the tape body 1 used in the section in the first stage is counted up synchronously with the pulse and reaches a set prescribed count value in the first stage, thereby completing the torque gradually decreasing control in the first stage of the torque value set data of the drive motor 106. The above-mentioned torque gradually decreasing control can be performed with 1000 steps, that is, with a resolution which is obtained by dividing a difference between the initial torque value set data for the drive motor 106, and the end point torque value set data in the first stage for the drive motor 106 by 1000.

The data on the length of the tape body 1 used in the section in the first stage reaches the prescribed value, and as a result, the torque gradually decreasing control proceeds to the control for the data on the length of the tape body 1 set for the section in the second stage in Step S105, and thus proceeds to the torque value gradually decreasing control of the drive motor 106 in the second stage.

Similarly to Step S103, the pulse signal is inputted at the 0.1 m intervals from the pulse generator 6 to the high-speed counter unit provided within the control/calculation device 2. In the calculation part of the control/calculation device 2, a result of dividing the value of the length of the tape body 1 used in the section in the second stage by the coefficient of 1000 is counted up synchronously with the pulse signal. In addition, a result of dividing a difference between the end point torque value set data in the first stage for the drive motor 106, and the end point torque value set data in the second stage for the drive motor 106 by the coefficient of 1000 in the calculation part of the control/calculation device 2 is changed to decrease little by little from the end point torque value set data in the first stage for the drive motor 106. That is to say, the result is inputted as a digital signal to the digital-analog conversion unit provided within the control/calculation device 2, and a current is outputted as an analog signal which is changed to slightly decrease. Thus, a signal is inputted to the servo amplifier 3A, and a voltage which is changed to slightly decrease is outputted to the drive motor 106, which results in that the torque outputted from the drive motor 106 is changed to decrease in correspondence to the value of the length of the tape body 1 used in the section in the first stage, thereby fixing the delivery tension of the tape body 1.

Also, in Step S106, the data on the length of the tape body 1 used in the section in the second stage is counted up synchronously with the pulse and reaches a set prescribed count value in the second stage, thereby completing the torque gradually decreasing control in the second stage of the torque value set data for the drive motor 106. Similarly to the torque gradually decreasing control in the first stage, the torque gradually decreasing control described above can be performed with the 1000 steps, that is, with the resolution which is obtained by diving the difference between the end point torque value set data in the first stage for the drive motor 106, and the end point torque value set data in the second stage for the drive motor 106 by 1000.

The data on the length of the tape body 1 used in the section in the second stage reaches the prescribed value, and as a result, the torque gradually decreasing control proceeds to the control for the data on the length of the tape body 1 set for the section in the third stage in Step S107, and thus proceeds to the torque value gradually decreasing control of the drive motor 106 in the third stage.

Similarly to Step S105, the pulse signal is inputted at the 0.1 m intervals from the pulse generator 6 to the high-speed counter unit provided within the control/calculation device 2. In the calculation part of the control/calculation device 2, a result of dividing the value of the length of the tape body 1 used in the section in the second stage by the coefficient of 1000 is counted up synchronously with the pulse signal. In addition, a result of dividing the difference between the end point torque value set data in the second stage for the drive motor 106, and the end point torque value set data in the third stage for the drive motor 106 by the coefficient of 1000 in the calculation part of the control/calculation device 2 is changed to decrease little by little from the end point torque value set data in the second stage for the drive motor 106. That is to say, the result is inputted as a digital signal to a digital-analog conversion unit provided within the control/calculation device 2, and a current is outputted as an analog signal which is changed to slightly decrease. Thus, a signal is inputted to the servo amplifier 3A, and a voltage which is changed to slightly decrease is outputted to the drive motor 106, which results in that the torque outputted from the drive motor 106 is changed to decrease in correspondence to the value of the length of the tape body 1 used in the section in the third stage, thereby fixing the delivery tension of the tape body 1.

Also, in Step S108, the data on the length of the tape body 1 used in the section in the third stage is counted up synchronously with the pulse and reaches a set prescribed count value in the third stage, thereby completing the torque gradually decreasing control in the third stage of the torque value set data for the drive motor 106. Similarly to the torque gradually decreasing control in each of the first and second stages, the torque gradually decreasing control described above can be performed with the 1000 steps, that is, with the resolution which is obtained by diving the difference between the end point torque value set data in the second stage for the drive motor 106, and the end point torque value set data in the third stage for the drive motor 106 by 1000.

In Step S109, the data on the length of the tape body 1 used in the section in the third stage reaches the prescribed value, and as a result, the torque gradually decreasing control by the drive motor 106 is stopped, and the torque is held in accordance with the end point torque value set data for the drive motor 106 in the third stage. In addition, a stop signal is outputted from the control/calculation device 2 in accordance with the count-up about the length of the tape body received in the receiving device 13 and is inputted to the servo amplifier 3B, thereby stopping/decelerating the drive motor 109. Also, in order to smoothly stop the tape pad fixing part 103, in-phase-of-deceleration addition torque value set data is inputted to the digital-analog conversion unit provided within the control/calculation device 2, the digital-analog conversion unit converts the digital signal thus inputted thereto into an analog signal, and outputs the resulting analog signal. Also, the resulting analog signal is added to a torque value of the drive motor 106, which results in that the tape body 1 is stopped without abnormality. After stop of the tape body 1, the torque value of the drive motor 106 is reset by turning OFF the operation preparation switch 5A.

EXAMPLE

Figure 6:
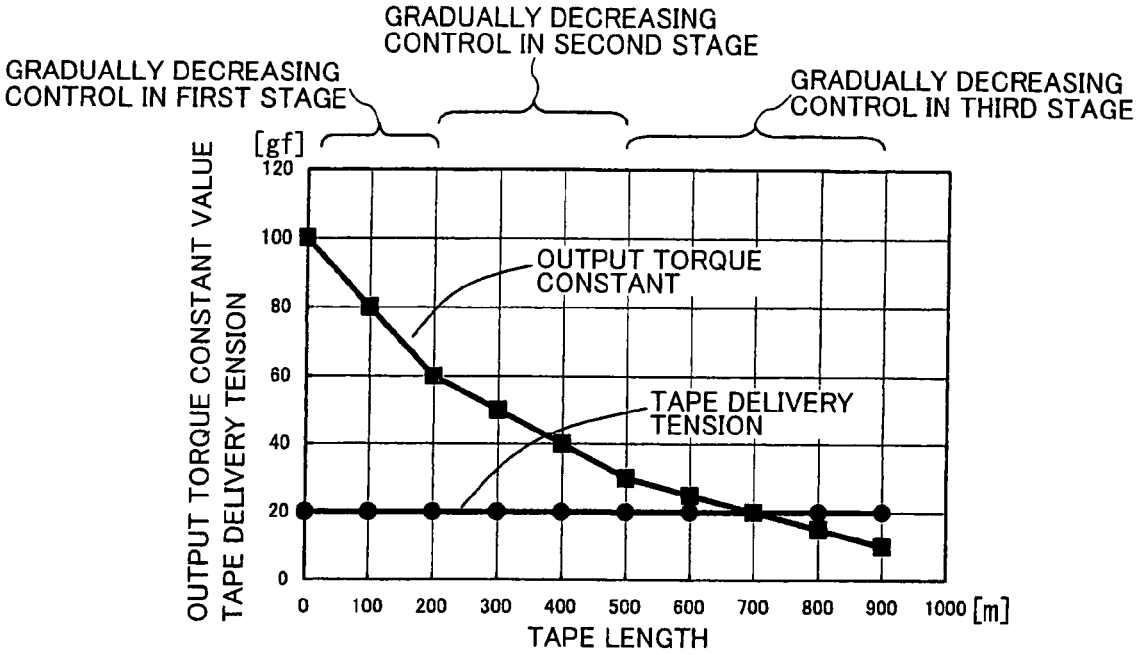
FIG. 6 is a graph showing a relationship among a length (tape length) of a tape body 1, an output torque constant value, and a tape delivery tension.
Figure 7:
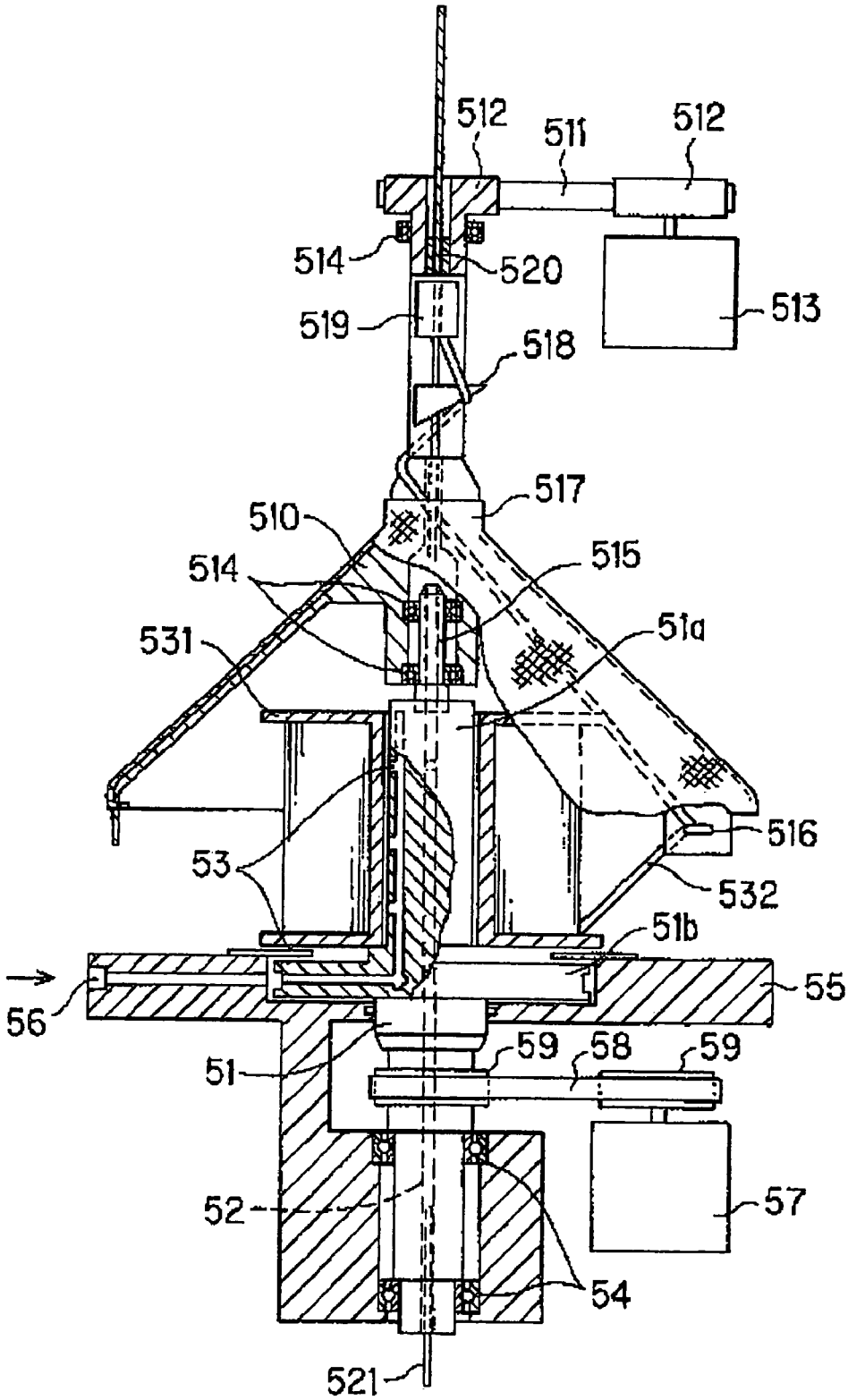
FIG. 7 is a cross sectional view showing a conventional tape winder.

FIG. 6 is a graph showing a relationship among the length (tape length) of the tape body 1, the output torque constant value, and the tape delivery tension. The output torque constant value of 100.00 and the data on the length of the tape body 1 of 900 m which correspond to the gradually decreasing value zero tension are inputted as the initial torque setting for the drive motor 106 by using the touch panel 4. In addition, the value of the number of rotations of 1500 rpm of the tape winding flyer 107 is inputted as the setting for the value of the number of rotations of the drive motor 109, and a value of 10000 m is inputted as a value of the length of the tape body received in the receiving device 13. In addition thereto, the product winding pitch set value of 6.6 mm is also inputted. In addition, a value of 200 m, and 60.00 are inputted as the value of the length of the tape body 1 used in the section in the first stage, and the end point torque value in the first stage of the drive motor 106, respectively. A value of 300 m, and 30.00 are inputted as the value of the length of the tape body 1 used in the second stage, and the end point torque value in the second stage of the drive motor 106, respectively. Also, a value of 400 m, and 10.00 are inputted as the value of the length of the tape body 1 used in the section in the third stage, and the end point torque value in the third stage of the drive motor 106, respectively.

When the torque gradually decreasing control in the three stages from Step S101 to Step S109 is performed in the state in which the values are set in the manner as described above, the torque value of the drive motor 106 is subjected to the gradually decreasing control in accordance with the output torque constant value shown in FIG. 5. As a result, although the delivery tension of the tape body 1 is controlled to a constant value of 20 gf in FIG. 6, actually, the delivery tension of the tape body 1 is set to a value of zero.

In addition, in this example, about 0.4 N is the proper tension as the tape tension when the fired PTFE tape is applied which is 4.6 mm in tape width, and 0.09 mm in thickness. Thus, in order to generate the tape tension of about 0.4 N, the tape body 1 is twined around each of the tension control rolls 110A and 110B (FIG. 4(*b*)). One tension control roll can generate the tension of about 0.2 N. Therefore, since the delivery tension of the tape body 1 from the tape pad 102 provided by the torque control for the drive motor 106 is set to a zero tension, and the tape body 1 is delivered approximately with the zero tension even if the number of windings of the tape body in the tape pad 102 changes, the tape body 1 is free from a change in shape such as tape extension or slippage. Note that, the actual tension when the tape body 1 is wound around the wire material 10 is about 0.5 N or so because of addition of the mechanical loss or the like in the tape guide rolls 122, 123 and 124.

As described above, the tape feed part causes the first drive source to undergo the rotating torque control, so that the tape body 1 is usually fed from the tape pad 102 with the proper delivery tension. Although the tape winding part coaxially and rotatably mounted to the tape feed part becomes unstable (in the tape tension value) because the second drive source fixedly fastened to an end of the tape winding part is rotated, thereby winding the tape body 1, the PTFE porous tape body which is 60% or more in porosity and 0.09 mm in thickness can be precisely wound by the apparatus for manufacturing a taped insulated conductor of the present invention since the tape winding tension is set to the specified tension value by the tension control rolls of the tape winding part.

While the present invention has been described with respect to the specific embodiments for the perfect and clear disclosure, the appended claims are not limited to these embodiments, and should be construed as embodying all changes and alternative constitutions which are properly contained in the scope of the basic teaching described in this specification and which can be supposed by those skilled in the art.

INDUSTRIAL APPLICABILITY

It is possible to provide the apparatus for manufacturing a taped insulated conductor which is capable of fixing the degree of adhesion of the tape body to the wire material, and manufacturing the electric wire through the stable tape winding.

In addition, it is possible to provide the apparatus for manufacturing a taped insulated conductor which is capable of winding even the tape body having a small tension.

The invention claimed is:

1. An apparatus for manufacturing a taped insulated conductor including a wire material feeder for feeding a wire material, a tape winder for winding a tape body around the wire material fed from the wire material feeder, and a receiving device for receiving the wire material around which the tape body is wound by the tape winder, the tape winder comprising:

a tape pad fixing part for fixing a tape pad around which the tape body is wound;

a tape feed part having a first drive source including a servo motor for rotatingly driving the tape pad fixing part, so that a rotating shaft torque is controlled to a prescribed torque, thereby setting a delivery tension of the tape body to a prescribed value;

a tape winding flyer rotatably mounted to an outside of the tape feed part and having a plurality of tension control rolls for controlling a tension of the tape; and a tape winding part having a second drive source including a servo motor for controlling a rotation of the tape winding flyer to the prescribed number of rotations;

wherein the tape body is fed from the tape pad to the tape winding flyer without a tension with the rotation having the rotating shaft torque controlled by the first drive source; the tape body fed to the tape winding flyer is wound around the wire material in a state in which a tension of the tape body is set to a specified value by the rotation made by the second drive source dependent on a contact area with which the tape body is twined around each of the tension control rolls.

2. An apparatus for manufacturing a taped insulated conductor according to claim 1, wherein a drive source for the receiving device is a servo motor for controlling the number of rotations to the prescribed number of rotations in order to set a receiving speed at which the wire material is received to a prescribed speed.

3. An apparatus for manufacturing a taped insulated conductor according to claim 2, wherein the second drive source rotatingly drives the tape winding flyer synchronously with the prescribed number of rotations used to make the receiving speed for the wire material constant by the drive source for the receiving device.

4. A tape winding tension controlling method of controlling a tension applied to a tape body for use in an apparatus for manufacturing a taped insulated conductor including a wire material feeder for feeding a wire material, a tape winder for winding the tape body around the wire material fed from the wire material feeder, and a receiving device for receiving the wire material around which the tape body is wound by the tape winder, wherein when tension of the tape body in the tape winder is controlled, a delivery tension of the tape body is set to a prescribed value by controlling a rotating shaft torque to a prescribed value by a first drive source having a servo motor for rotatingly driving a tape pad fixing part for fixing a tape pad around which the tape body is wound; and next, for the tape body fed to a tape winding flyer mounted to an outside of the tape pad fixing part and having a plurality of tension control rolls for controlling a tension of the tape, a tension applied to the tape body to be wound around the wire material is usually set to a specified tension without relying on the number of windings of the tape body by controlling the number of rotations to the prescribed number of rotations by a second drive source having a servo motor for rotatingly the tape winding flyer, and the tension of the tape body right before the tape body is fed to the tape winding flyer and is wound around the wire material is set to a prescribed tension obtained by twining the tape body around each of the plurality of the tension control rolls provided in the tape winding flyer, and being dependent on a contact area with which the tape body is twined around each of the tension control rolls.

5. A tape winding tension controlling method according to claim 4, wherein a receiving speed at which the wire material is received is controlled to a prescribed speed by controlling the number of rotations to the prescribed number of rotations by a servo motor as a drive source for the receiving device.

6. A tape winding tension controlling method according to claim 5, wherein the second drive source rotatingly drives the tape winding flyer synchronously with the prescribed number of rotations used to make the receiving speed for the wire material constant by a drive source for the receiving device, so that a winding pitch of the tape body wound around the wire material is controlled to a constant value.

* * * * *